US005667743A

United States Patent [19]

Tai et al.

[11] Patent Number: 5,667,743

[45] Date of Patent: Sep. 16, 1997

[54] WET SPINNING PROCESS FOR ARAMID POLYMER CONTAINING SALTS

[75] Inventors: Tsung-Ming Tai, Chesterfield; David J. Rodini, Midlothian, both of Va.; James C. Masson, Mooresville, N.C.; Richard L. Leonard, Decatur, Ala.

[73] Assignee: E. I. Du Pont de Nemours and Company, Wilmington, Del.

[21] Appl. No.: 651,174

[22] Filed: May 21, 1996

[51] Int. Cl.[6] ..... D01D 5/06; D01F 6/60

[52] U.S. Cl. ..... 264/184; 264/210.4; 264/210.5; 264/210.8; 264/211.15; 264/211.16; 264/233

[58] Field of Search ..... 264/184, 210.4, 264/210.5, 210.8, 211.15, 211.16, 233

[56] References Cited

U.S. PATENT DOCUMENTS

| | | | |
|---|---|---|---|
| 3,068,188 | 12/1962 | Beste et al. | 524/104 |
| 3,079,219 | 2/1963 | King | 264/184 |
| 3,094,511 | 6/1963 | Hill, Jr. et al. | 528/337 |
| 3,133,138 | 5/1964 | Alexander, Jr. | 264/235.6 |
| 3,287,324 | 11/1966 | Sweeny | 528/348 |
| 3,353,379 | 11/1967 | Taylor, Jr. | 68/181 R |
| 3,414,645 | 12/1968 | Morgan, Jr. | 264/184 |
| 3,642,706 | 2/1972 | Morgan, Jr. | 524/233 |
| 4,342,715 | 8/1982 | Shimada et al. | 264/184 |
| 4,482,603 | 11/1984 | Yoshida et al. | 428/287 |
| 4,529,763 | 7/1985 | Tamura et al. | 524/230 |
| 4,842,796 | 6/1989 | Matsui et al. | 264/184 |

FOREIGN PATENT DOCUMENTS

| | | |
|---|---|---|
| 48-1435 | 1/1973 | Japan . |
| 48-19818 | 3/1973 | Japan . |
| 50-52167 | 5/1975 | Japan . |
| 63-17126 | 11/1981 | Japan . |
| 60-88113 | 10/1983 | Japan . |
| 60-88114 | 11/1983 | Japan . |
| 2-104719 | 4/1990 | Japan . |
| 1688612 | 7/1989 | U.S.S.R. . |

OTHER PUBLICATIONS

Wet Spinning of Aliphatic and Aromatic Polyamides, Tony A. Hancock, Joseph E. Spruiell, and James L. White, *Journal of Applied Polymer Science*, vol. 21, 1227–1247 (1977), pp. 1227–1247.

Coagulation Phenomena of Poly–m–Phenylene Isophthalamide/N–Methylpyrrolidone Solution; Keiji Kouzal et al.; Tokyo Research Center, Teijin, Ltd., 4–3–2 Asahigaoka, Hino, Tokyo, 191 Japan; *Sen–i Gakkaishi* 48, No. 2:55–65 (1992).

Wet Spinning of Poly–m–Phenylene Isophthalamide Fiber in Aqueous Solution of Calcium Chloride, Keiji Kouzal et al.; Tokyo Research Center, Teijin, Ltd., 4–3–2 Asahigaoka, Hino, Tokyo, 191 Japan; *Sen–i Gakkaishi* 48, No. 2:67–73 (1992).

Translation of Japan 56–5,844 (Published Feb. 7, 1981).

*Primary Examiner*—Leo B. Tentoni

[57] ABSTRACT

A process for wet spinning a meta-aramid polymer solutions having a salt content of at least 3 percent by weight produces a one step, fully wet drawable fiber that has desirable physical properties without subjecting the fiber to hot stretching.

7 Claims, 5 Drawing Sheets

WET SPINNING PROCESS FOR ARAMID POLYMER CONTAINING SALTS

The present invention relates to the wet spinning of meta-aramid polymers or co-polymers containing at least 25 mole percent meta-aramid (with respect to the polymer) from solutions containing in excess of three (3%) percent by weight salt.

BACKGROUND OF THE INVENTION

Commonly meta-aramid polymers useful for spinning fiber are obtained from the reaction, in a solvent, of a dime and a diacid chloride, typically isophthaloyl chloride. This reaction produces hydrochloric acid as a by-product. Generally in manufacturing, this acid by-product is neutralized by the addition of a basic compound to form a salt. Depending on the selection of the basic compound and the polymerization solvent, the salt formed on neutralization may be insoluble in the polymer solution and therefore precipitate out of the solution, or the salt may be soluble as a salt-polymer and/or salt solvent complex. Thus, spinning solutions are known which range from salt-free to having a relatively high concentrations of salt. For example, if no salt is removed from the typical meta-aramid, base neutralized polymerization reaction solution (approximately 20% by weight polymer solids), the salt concentrations in the polymer solution may be as high as 9% by weight.

There is an advantage to directly spin polymer synthesis solutions containing high concentrations of salt. Although salt content is known to be beneficial in the spinning solution as a means to increase polymer solution stability, the wet spinning of meta-aramid polymer from solutions containing concentrations of three percent (3%) or more by weight salt has generally resulted in fibers having poor mechanical and other physical properties. In practice wet spinning of meta-aramid fibers having acceptable physical properties was accomplished from salt-free polymer solutions or from polymer solutions containing low concentrations of salt. Polymer solutions containing low concentrations of salt are those solutions that contain no more than 3% by weight salt. There are teachings of wet spinning processes from high salt containing solutions, but in order to develop acceptable mechanical properties in the fibers produced from these processes, the fiber must be subjected to a hot stretch.

In one method to produce a low salt spinning solution, the polymerization is carded out with at least two additions of the diacid chloride. The polymerization is initiated by the addition of an mount of the diacid chloride that is less than required for complete polymerization of the diamine. Anhydrous ammonia is typically added to this polymerization reaction solution while the solution viscosity is still low enough to allow the separation of a solid phase from the solution. The anhydrous ammonia neutralizes the hydrochloric acid that has formed as a result of the polymerization, forming ammonium chloride, which is insoluble in the polymer solution and may be removed. Additional diacid chloride may then be added to the reaction solution to complete the polymerization. Acid resulting from this second phase of polymerization may be neutralized producing a low concentration of salt in the polymer solution that is used for spinning.

Salt-free polymer can be made by removal of hydrochloric acid from the reaction solution or by the removal of salt from a neutralized reaction mixture, but the processing requires a number of steps and additional economic investment. Salt-free spinning solutions may be spun without the addition of salt, or salt can be added to some specifically desired concentration.

As noted above, prior art taught wet spinning processes for low salt and even high salt containing spin solutions; however, these processes required hot stretches to provide a product with acceptable mechanical properties. In particular, some substantial mount of hot stretching and fiber crystallization was required in these processes to provide mechanical integrity to these wet spun fibers.

The hot stretching necessary to develop mechanical properties in the fibers also causes limitations in fiber use. It is known in the art of spinning aramid fibers that exposing the fiber to temperatures at or near the polymer glass transition temperature, produces some degree of crystallization. While crystallizing the fiber improves certain physical and mechanical properties, it causes the fiber to be especially difficult to dye. These crystallized (hot stretched), difficult to dye fibers are limited in their use in textile applications. Until the development of the present invention, it has not been possible to produce wet spun meta-aramid fibers having excellent physical properties and improved dyeability.

The difficulty in producing meta-aramid fibers from wet spinning of salt-containing spin solutions is evident in the earlier patent literature. For example, U.S. Pat. No. 3,068,188 to Beste, et al. suggested that fibers could be spun by either wet or dry spinning processes, but did not disclose any process for wet spinning. Fibers produced by wet spinning polymer solutions containing high concentrations of salt were generally characterized by the presence of large voids. These voids affected the ability of the fiber to be effectively drawn. On drawing, void-containing fibers were not only subject to a greater degree of fiber breakage, but those fibers that were successfully drawn developed mechanical properties which were much lower than the properties that could be developed in dry spun fibers or in fibers which were wet spun salt-free polymer solutions. Dry spinning and wet spinning from salt free polymer solutions are methods known to produce fibers that are free of large voids.

The deficiencies of fibers produced by wet spinning before the process of the present invention are evidenced by U.S. Pat. No. 3,414,645 to Morgan which taught the advantages of the air-gap (dry-jet wet) spun, void-free fiber over that of a wet spun fiber; by U.S. Pat. No. 3,079,219 to King which taught that a calcium thiocyanate containing coagulation bath was required to improved the strength and produce serviceable wholly aromatic, wet spun polyamide fibers and by U.S. Pat. No. 3,642,706 to Morgan which taught the incorporation of a wax into the polymer spinning solution to improve physical properties of wet spun meta-aramid fiber.

Staged wet draws combined with hot stretching was taught in U.S. Pat. No. 4,842,796 to Matsui et al. for fibers produced primarily from salt-free spinning solutions. Japanese Pat. Publication Kokai 48-1435 and Kokai Sho 48-19818 taught the combination of certain salt/solvent ratios in the coagulation bath coupled with hot fiber stretches to crystallize the fiber. Japanese Patent Publication Kokolm Sho 56-5844 taught the combination of two coagulation baths to exhaust solvent from the fiber followed by conventional drawing and hot stretch crystallization to produce suitable wet spun fiber from polymer spinning solutions having high salt concentrations.

The present invention provides a process by which polymer solutions rich in salt may be wet spun and fully wet drawn in a single stage to achieve desirable and useful mechanical properties without the need of a hot stretch and fiber crystallization. The fiber produced by the present process is more easily dyed to deep shades. The fiber made from the process of the present invention may, optionally, be heat treated and crystallized to produce properties required for industrial and other high performance applications.

SUMMARY OF THE INVENTION

This invention provides a process for wet spinning a meta-aramid polymer from a solvent spinning solution containing concentrations of polymer, solvent, water and more than 3% by weight (based on the total weight of the solution) salt comprising the steps of:

(a) coagulating the polymer into a fiber in an aqueous coagulation solution in which is dissolved a mixture of salt and solvent such that the concentration of the solvent is from about 15 to 25% by weight of the coagulation solution and the concentration of the salt is from about 30% to to 45% by weight of the coagulation solution and wherein the coagulation solution is maintained at a temperature from about 90° to 125° C.;

(b) removing the fiber from the coagulation solution and contacting it with an aqueous conditioning solution containing a mixture of solvent and salt such that the concentrations of solvent, salt and water are defined by the area shown in FIG. 1 as bounded by coordinates W, X, Y and Z and wherein the conditioning solution is maintained at a temperature of from about 20° to 60° C.;

(c) drawing the fiber in an aqueous drawing solution having a concentration of solvent of from 10 to 50% by weight of the drawing solution and a concentration of salt of from 1 to 15% by weight of the drawing solution;

(d) washing the fiber with water; and (e) drying the fiber.

The concentration of salt in the spinning solution is at least 3% by weight. Concentrations of salt may be as high as allowed by limitations of spin solution viscosity. Salt concentration of more than 3% are preferred; concentrations of 9% are most preferred.

Before washing, the coagulated and conditioned fiber from the present process may be wet drawn in a single step to produce a fiber having physical properties that are equal to fibers produced by other known processes requiting both staged wet draw and/or hot stretching.

The drying step preferably is carried out at temperatures and times sufficient to remove water from the fiber without inducing substantial crystallization of the polymer. Preferably the drying temperature is about 125° C.

Optionally, the fiber can be heat treated at a temperature, generally near the glass transition temperature of the polymer, and for a time sufficient to essentially crystallize the polymer.

In a continuous process such as most commercial processes, the salt content of the fiber provides sufficient salt concentration for the drawing solution. There is no requirement to add additional salt, but additional salt may be added. Ideally the total concentration of salt is preferably not more than 25% by weight of the drawing solution.

In wet drawing the fibers of the present invention, draw ratios of from 2.5 to 6 are preferred. Fibers produced by the process of the present invention have a tenacity of greater than 3.3 decitex per filament (3 gpd) and an elongation at break of from 10 to 85%.

BRIEF DESCRIPTION OF THE DRAWINGS

FIG. 2 shows cross sections of fiber shapes wet spun and conditioned according to the process of the present invention.

DETAILED DESCRIPTION

Figure 1:
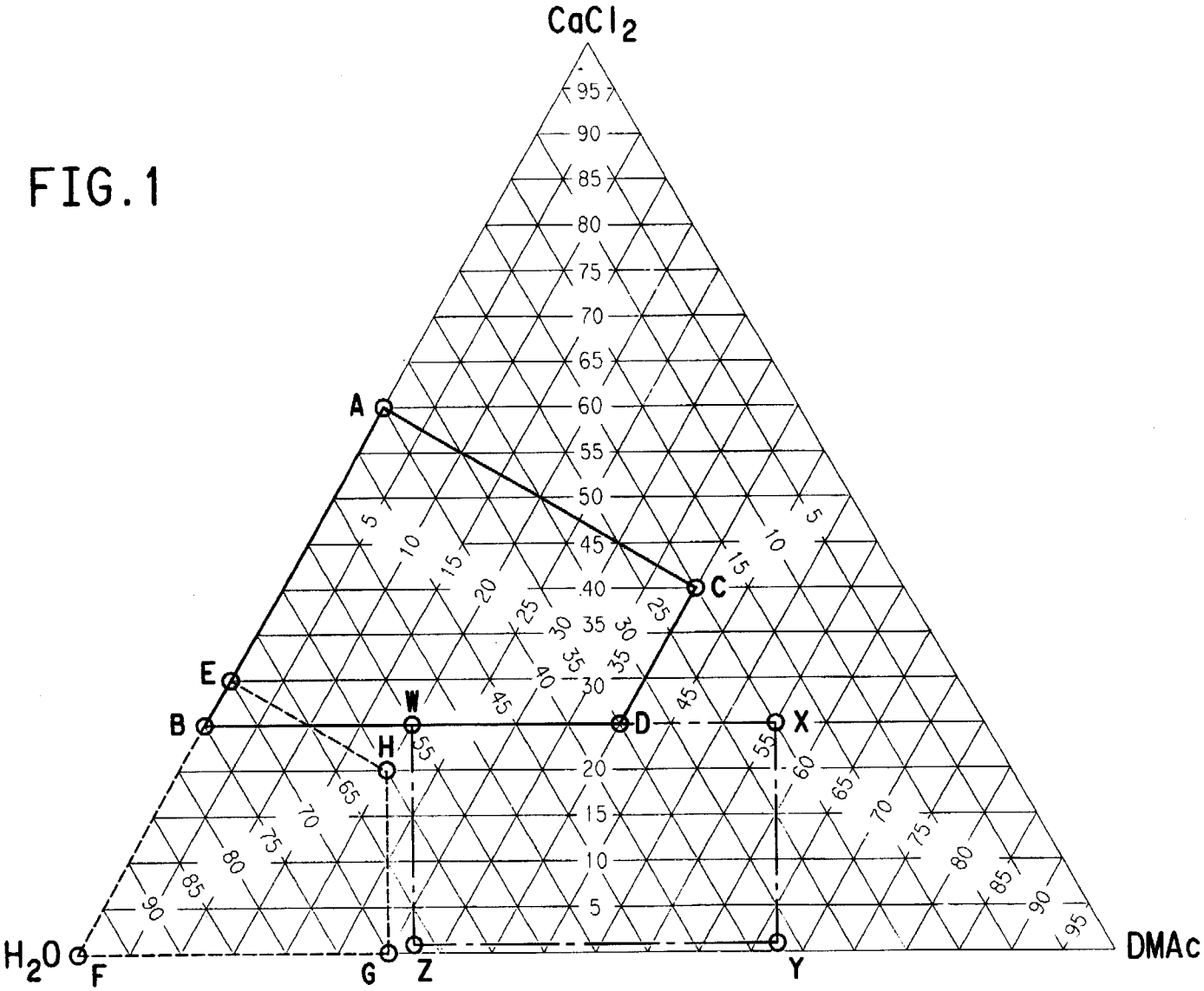
FIG. 1 shows compositions of coagulation solutions, regions bounded by co-ordinates A,C, D and B and E, H G and F of prior art and the compositions of the conditioning solutions of the present invention, the region bounded by co-ordinates W, X, Y and Z.

The term "wet spinning" as used herein is defined to be a spinning process in which the polymer solution is extruded through a spinneret that is submerged in a liquid coagulation bath. The coagulation bath is a nonsolvent for the polymer.

The term hot stretch or hot stretching as used herein defines a process in which the fiber is heated at temperatures near or in excess of the glass transition temperature of the polymer, (for poly(m-phenylene isophthalamide), for example, a temperature near to or in excess of 250° C.) while at the same time the fiber is drawn or stretched. The drawing is typically accomplished by applying tension to the fiber as it moves across and around rolls traveling at different speeds. In the hot stretch step fiber is both drawn and crystallized to develop mechanical properties.

Poly(m-phenylene isophthalamide), (MPD-I) and other meta-aramids may be polymerized by several basic processes. Polymer solutions formed from these processes may be rich in salt, salt-free or contain low amounts of salt. Polymer solutions described as having low amounts of salt are those solutions that contain no more than 3.0% by weight salt. Any of these polymer solutions may be wet spun by the process of the present invention provided that the salt content, either resulting from the polymerization, or from the addition of salt to a salt-free or low salt-containing solution, is at least 3% by weight.

Salt content in the spinning solution generally results from the neutralization of by-product acid formed in the polymerization reaction; but salt may also be added to an otherwise salt-free polymer solution to provide the salt concentration necessary for the present process.

Salts that may be used in the present process include chlorides or bromides having cations selected from the group consisting of calcium, lithium, magnesium or aluminum. Calcium chloride or lithium chloride salts are preferred. The salt may be added as the chloride or bromide or produced from the neutralization of by-product acid from the polymerization of the aramid by adding to the polymerization solution oxides or hydroxides of calcium, lithium, magnesium or aluminum. The desired salt concentration may also be achieved by the addition of the halide to a neutralized solution to increase the salt content resulting from neutralization to that desired for spinning. It is possible to use a mixture of salts in the present invention.

The solvent is selected from the group consisting of those solvents which also function as a proton acceptors, for example dimethylforamide (DMF), dimethylacetamide (DMAc), N-methyl-2-pyrrolidone (NMP). Dimethyl sulfoxide (DMSO) may also be used as a solvent.

The present invention relates to a process for the production of fibers made of aramids containing at least 25 mole %

(with respect to the polymer) of the recurring structural unit having the following formula, $$[—CO—R^1—CO—NH—R^2—NH—], \quad (I)$$

The $R^1$ and/or $R^2$ in one molecule can have one and the same meaning, but they can also differ in a molecule within the scope of the definition given.

If $R^1$ and/or $R^2$ stand for any bivalent aromatic radicals whose valence bonds are in the meta-position or in a comparable angled position with respect to each other, then these are mononuclear or polynuclear aromatic hydrocarbon radicals or else heterocyclic-aromatic radicals which can be mononuclear or polynuclear. In the case of heterocyclic-aromatic radicals, these especially have one or two oxygen, nitrogen or sulphur atoms in the aromatic nucleus.

Polynuclear aromatic radicals can be condensed with each other or else be linked to each other via C—C bonds or via bridge groups such as, for instance, —O—, —$CH_2$—, —S—, —CO— or $SO_2$—.

Examples of polynuclear aromatic radicals whose valence bonds are in the meta-position or in a comparable angled position with respect to each other are 1,6-naphthylene, 2,7-naphthylene or 3,4'-biphenyldiyl. A preferred example of a mononuclear aromatic radical of this type is 1,3-phenylene.

In particular it is preferred that the directly spinnable polymer solution is produced which, as the fiber-forming substance, contains polymers with at least 25 mole % (with respect to the polymer) of the above-defined recurring structural unit having Formula I. The directly spinnable polymer solution is produced by reacting dimes having Formula II with dicarboxylic acid dichlorides having Formula III in a solvent:

$$H_2N—R^2—NH_2 \quad (II),$$

$$ClOC—R^1—COCl \quad (III),$$

The preferred meta-aramid polymer is MPD-I or co-polymers containing at least 25 mole % (with respect to the polymer) MPD-I.

Although numerous combinations of salts and solvents may be successfully used in the polymer spin solutions of the process of the present invention, the combination of calcium chloride and DMAc is most preferred.

Figure 4:
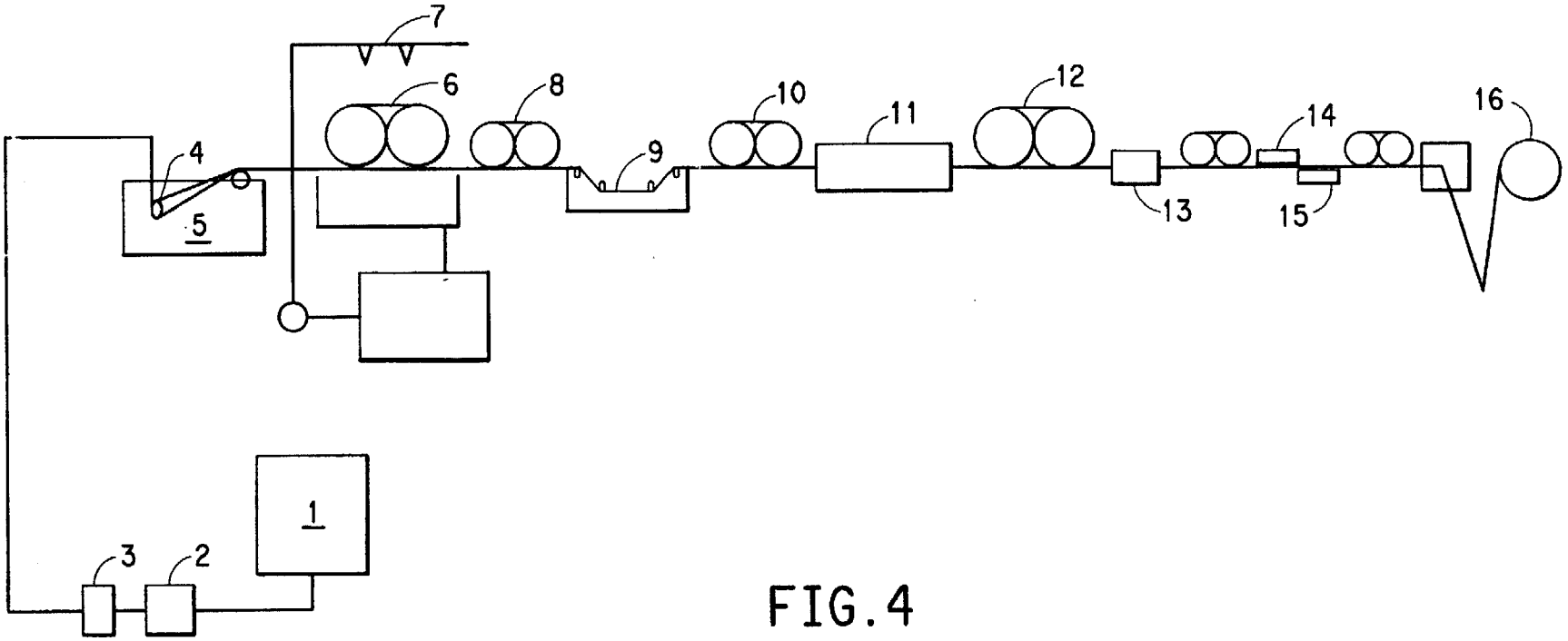
FIG. 4 shows a diagram of the process steps and techniques that may be used in the practice of the present invention.

The present process may be used as a continuous process to make fiber. An example of a continuous process is shown in the diagram of FIG. 4. The polymer spinning solution is pumped from a dope pot (1) by a feed pump (2) through a filter (3) and into and through a spinneret (4). The spinneret extends below the surface of a coagulation solution which is temperature controlled in the range of from 90° to 125° C. The coagulation solution of the present process will produce fibers that can be successfully conditioned even if the bath is maintained at temperatures which exceed 125° C. Practically, although not theoretically, the coagulation bath temperature is limited to an upper operation temperature of about 135° C. for the DMAc solvent system since at temperatures in excess of 135° C. solvent loss generally exceeds the cost efficiency of solvent replacement and/or recovery. The coagulation solution is housed in a coagulation bath (5) (sometimes called a spin bath). The fiber bundle forms in the coagulation bath and exits the bath on to a first roll (6). As the fiber bundle moves on to the surface of the roll, it is contacted by a conditioning solution. The conditioning solution can be sprayed on the individual fibers (7) or applied by a jet extraction module (sometimes called a mass transfer unit) or a combination of spray and jet extraction. When a jet extraction module is used the first rolls may be by-passed.

It is of primary importance that the conditioning solution contact each individual fiber in the fiber bundle in order for the solution to condition the fibers for proper drawing.

Fiber exiting the conditioning treatment may be drawn. The fibers may be wet drawn in one step using a drawing solution that contains water, salt and solvent; the solvent concentration is selected so that it is less than the solvent concentration in the conditioning solution. The fibers may be drawn using two sets of rolls (8) and (10) with the draw bath (9) situated in between the sets of rolls. The draw bath may be replaced by jet extraction modules, for example, as described in U.S. Pat. No. 3,353,379. The speeds of the rolls at the entrance of the draw bath and at the exit of the draw bath are adjusted to give the desired draw ratio. The present process can achieve draw ratios as high as 6. The concentration range of the drawing solution is by weight percent 10 to 50% DMAc. The concentration of salt can be as high as 25% by weight of the drawing solution. There will be salt present in the solution since salt will be removed from the fiber by contact with the drawing solution. The preferred concentration of salt in the drawing solution is about 4%. If it is desired to increase the salt content above this level sustained by the total process, additional salt may be added. The temperature of the drawing solution is maintained from 20° to 80° C. The wet draw may be done in a bath or by using jet extraction modules or by any other technique that sufficiently wets the fibers.

After drawing the fiber is washed with water in the washing section (11). The method used to wash the fibers is not critical, and any means or equipment may be used which will remove the solvent and salt from the fiber. After washing, the fiber may be dried (12) and then processed for end use applications or the fiber may be dried and then subjected to additional heat treatment to cause crystallization by passing the fiber through a hot robe (13), over hot shoes (14 and 15) or over heated rolls. The fiber is typically dried at about 120° to 125° C. and crystallized at temperatures which are greater than the glass transition temperature of the polymer. For MPD-I, the heat treatment necessary to achieve substantial crystallization requires temperatures equal to or in excess of 250° C. The present process does not require a hot stretch to develop high tenacity fibers, thus the fiber speeds may be maintained at a constant rate from the exit of the draw bath through the finishing bath (16).

Since the fibers of the present invention are dried at temperatures significantly below the glass transition temperature of the polymer, the resulting fibers remain in an essentially amorphous state. By heat treating the fibers above the glass transition temperature, the fibers may be crystallized. Crystallization increases the density of the fibers and increases the heat stability reducing the susceptibility for shrinkage.

It is well known that both amorphous and crystalline meta-aramid fibers are difficult to dye, when compared with traditional textile fibers such as nylon or cotton. However, when amorphous and crystalline aramid fibers are compared, the fibers having a greater degree of polymer crystallinity are the more difficult to dye. Wet spinning processes taught to date have required hot stretching to achieve mechanical properties, i.e., increased tenacity, sufficient for textile use. A particularly useful aspect of the present invention is the ability of the process to produce amorphous fibers which have tenacities in the range of fully crystallized fiber, while at the same time providing a fiber which retains the dyeability which is characteristic of a fully amorphous fiber. The high tenacity fibers of the present invention may be pigmented or otherwise colored first followed by crystallization so long as the means of providing color to the fiber is stable at the crystallization temperature and will not contribute to a degradation of the fibers. Of course, fibers made by the present process may simply be crystallized to produce a fiber having mechanical properties and improved resistance to heat shrinkage for industrial applications.

The present process develops in the coagulation, conditioning and drawing steps a fiber that is easily dyeable by conventional aramid dyeing processes. Since no heat treatment other than drying is required to perfect good physical properties, the fiber need never be altered by heating so as to impair its dyeability.

Critical to the present invention is the conditioning step for the fiber, which follows immediately the coagulation step. Prior processes have taught the use of multiple baths which were used to coagulate the fiber rather than condition the fiber for drawing. While such secondary baths may appear similar to the present conditioning step, the function and composition of these secondary baths compared to that of the subject conditioning bath differ significantly. These secondary coagulation baths attempt to further coagulate the filaments of extruded polymer fiber by continuing to remove solvent from the fiber, and are therefore, simply extensions of the first coagulation bath. The object of the coagulation or series of such coagulation baths is to deliver at the bath's exit a fully coagulated and consolidated fiber which is low in solvent content.

The conditioning step of the present invention, however, is not designed for coagulation, but rather to maintain the concentration of solvent in the fiber so that the fiber is plasticized. The fiber is both stabilized by the conditioning solution and swollen by solvent. Stabilized in this way, the fiber may be drawn fully without breaking. Under the tension of drawing any large voids collapse as the polymer is forced into the drawn shape.

To maintain the fiber in a plasticized state, it is essential that the concentration of the conditioning solution be within the area defined by the co-ordinates W, X, Y and Z as shown on FIG. 1. These coordinates define combinations of solvent, salt and water that, at the temperatures of 20° to 60° C., will limit diffusion of solvent from the fiber structure and maintain a plasticized polymer fiber. The coordinates: W (20/25/55), X (55/25/20), Y (67/1/32) and Z (32/1/67); are presented as weight percent of the total conditioning solution of solvent/salt/water, respectively.

The conditioning solution concentrations of the present invention are also compared to the primary and secondary coagulation solutions taught in prior art in FIG. 1. In FIG. 1, the primary coagulation bath concentrations of the prior art are those concentrations defined by the region bounded by co-ordinates A, C, D and B; while the concentrations taught for the second coagulation bath are those concentrations defined by the region bounded by co-ordinates E, H, G and F.

Figure 2A:
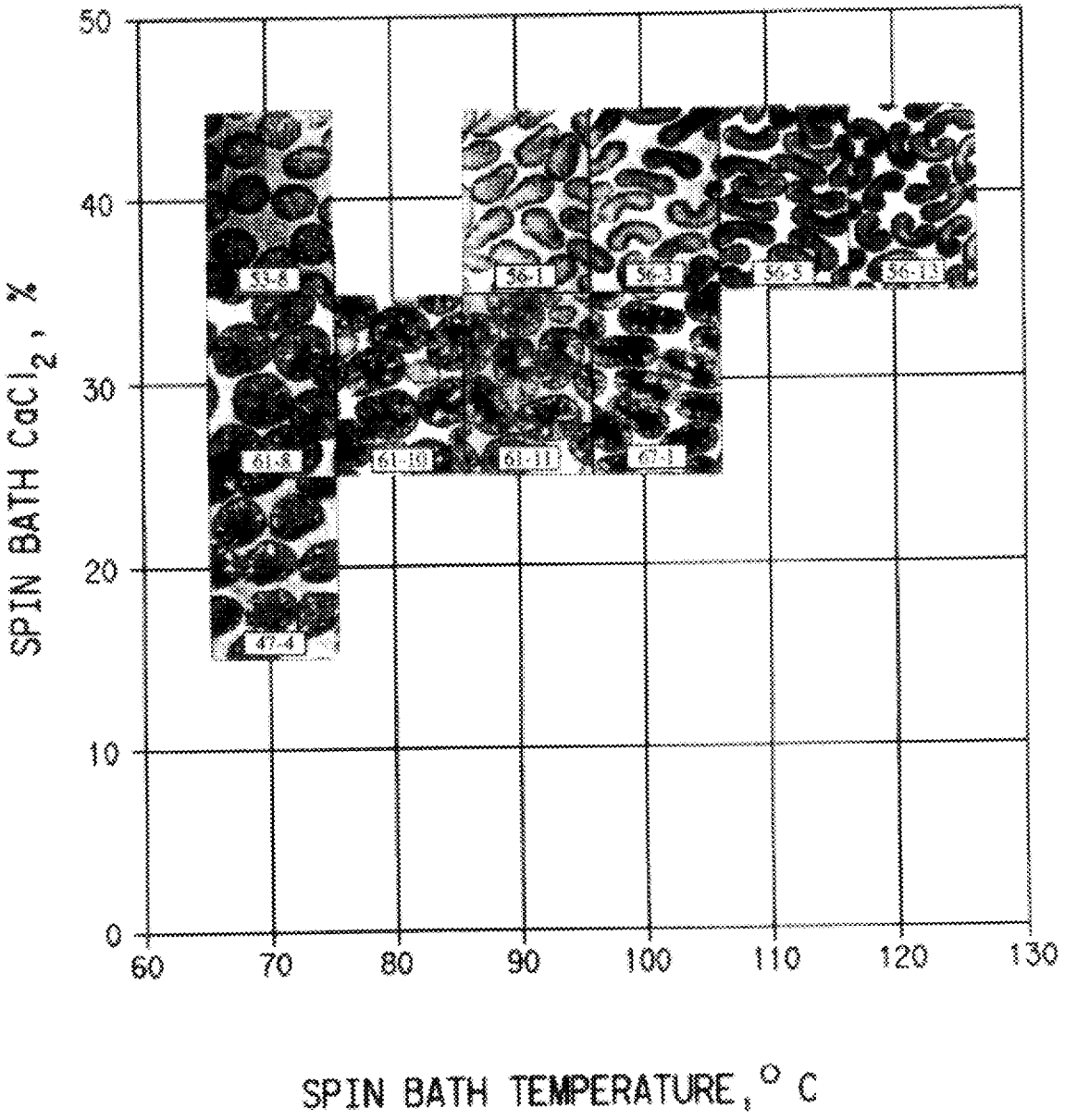
FIG. 2*a* shows fiber cross sections following conditioning.
Figure 2B:
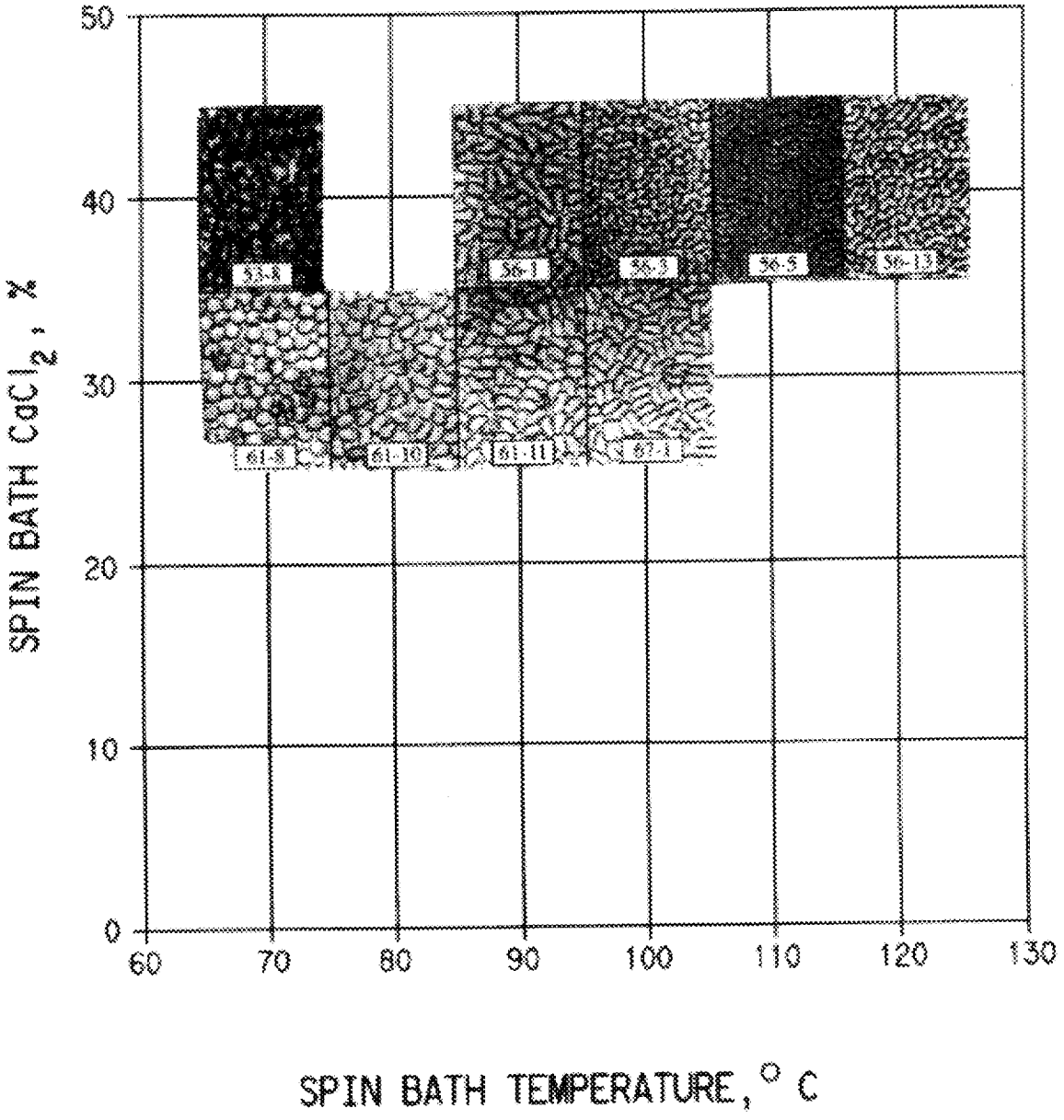
FIG. 2*b* shows fiber cross sections following wet drawing, washing and crystallization.

The inventors believe that the present process, by using a combination of coagulation and conditioning solutions and controlled temperatures, allows the salt and solvent to diffuse from the coagulated fiber, and even though macro-voids form in the fiber, the fiber shape is eliptical to bean shaped having the voids located near the fiber surface. FIG. 2*a* illustrates fibers produced at calcium chloride concentrations greater than 20% and at temperatures greater than 70° C. are eliptical in shape with voids located at the fiber surface. Fibers produced at calcium chloride concentrations below about 19% and at a conditioning solution at or below 60° C., were round in shape and the voids were dispersed through the fiber structure. Thus, by coagulating and conditioning the fiber to produce the desired fiber shape and void distribution in a plasticize polymer fiber, the fibers of the present invention may be wet dram and the voids eliminated at temperatures well below that of the polymer glass transition temperature as shown in FIG. 2*b*. The fiber that is formed by the present process may be wet drawn in a single step to yield physical properties that are equal to those achieved by conventional dry spinning processes or achieved by wet spinning processes that require staged draws and/or hot stretches.

In prior art processes, macro-voids were also formed in the fibers. In order for these voids to be collapsed and for the filaments to be drawn at ratios large enough for the development of good physical properties, these fibers had to be heated at temperatures near the glass transition temperature to avoid fiber breakage or damage. With the requirement for hot stretching (and therefore crystallization), the relative ease of dyeing a noncrystalline fiber was lost.

Figure 3A:
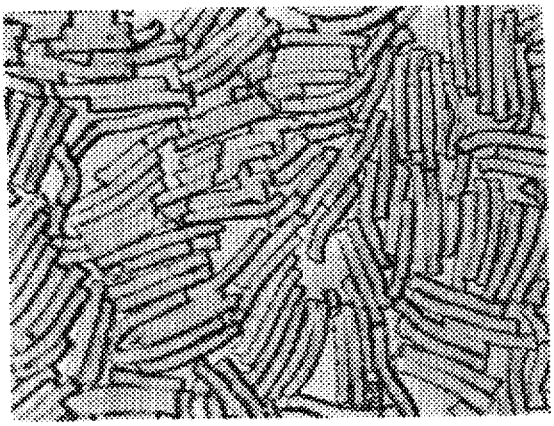
FIGS. 3A and 3B show fibers of the present invention having modified ribbon and trilobal cross sections, respectively
Figure 3B:
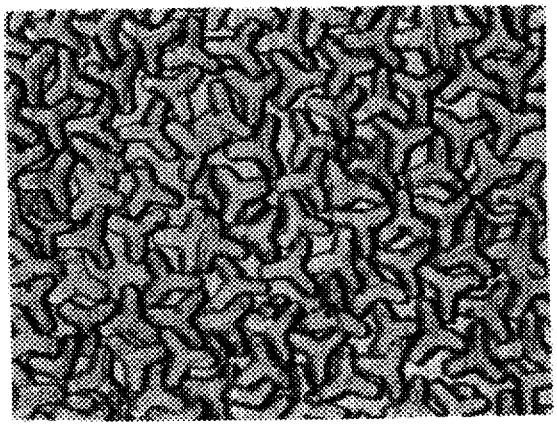

The process of the present invention makes it possible to achieve a variety of fiber shapes, including round, bean or dog-bone. Ribbon shapes may be made using a slotted hole spinneret; trilobal shaped cross sections may be made from a "Y" shaped hole spinneret as shown in FIG. 3B.

TEST METHODS

Inherent Viscosity (IV) is defined by the equation:

$$IV=\ln(h_{rel})/c$$

where c is the concentration (0.5 gram of polymer in 100 ml of solvent) of the polymer solution and $h_{rel}$ (relative viscosity) is the ratio between the flow times of the polymer solution and the solvent as measured at 30° C. in a capillary viscometer. The inherent viscosity values are reported and specified herein are determined using DMAc containing 4% by weight lithium chloride.

Fiber and yam physical properties (modulus, tenacity and elongation) were measures according to the procedures of ASTM D885. The twist for fibers and yams was three per inch (1.2 per centimeter) regardless of defiler.

Toughness factor (TF) is the product of the tenacity, measured in units of grams per denier, and the square root of the elongation, and is a property used commonly in industrial aramid fiber evaluations.

Examination of the wet spun fiber cross-section during the different stages of the present process provide insight into fiber morphology. To provide cross sections of a dried fiber, fiber samples were micro-tomed, but since the fibers had not been subjected to drawing or washing special handling was required to ensure that the fiber structure was not unduly influenced during the fiber isolation steps. To preserve the fiber structure during the process of cross sectioning, coagulated or coagulated and conditioned fiber was removed from the process and placed into a solution of similar composition from which it was removed. After about 10 minutes, about one half of the volume of this solution was removed and replaced with an equal volume of water containing about 0.1% by weight of a surfactant. This process of replacing approximately one half of the volume of the solution in which the fiber samples were contained with the surfactized water was continued until nearly all of the original solution had been replaced with surfactized water. The fiber sample was then removed from the liquid and dried in a circulating air oven at about 110° C. The dried fiber was then microtomed and examined under the miscroscope.

The following examples are illustrative of the invention and are not to be construed as limiting.

EXAMPLES

Example 1

A polymer spinning solution was prepared in a continuous polymerization process by reacting metaphenylene diamine with isophthaloyl chloride. A solution of one part metaphenylene diamine dissolved in 9.71 parts of DMAc was metered through a cooler into a mixer into which 1.88 parts of molten isophthaloyl chloride was simultaneously metered. The mixed was proportioned and the combined flow of the reagents was selected to result in turbulent mixing. The molten isophthaloyl chloride was fed at about 60° C. and the metaphenylene diamine was cooled to about −15° C. The reaction mixture was directly introduced into a jacked, scrapped-wall heat exchanger having a length to diameter ratio of 32 and proportioned to give a hold-up time of about 9 minutes. The heat exchanger effluent flowed continuously to a neutralizer into which was also continuously added 0.311 lb. of calcium hydroxide for each pound of polymer in the reaction solution. The neutralized polymer solution was heated under vacuum to remove water and concentrate the solution. The resulting polymer solution was the polymer spin solution and used in the spinning process described below.

This polymer spin solution had an inherent viscosity of 1.55 as measured in 4.0% lithium chloride in DMAc. The polymer concentration in this spinning solution was 19.3% by weight. The spin solution also contained 9.0% by weight calcium chloride and about 1% by weight water. The concentration of the DMAc was 70.7% by weight.

This solution was placed in a dope pot and heated to approximately 90° C. and then fed by way of a metering pump and filter through a spinneret having 250 holes of 50.8 microns (2 mils) diameter. The spinning solution was extruded directly into a coagulation solution that contained by weight 15% DMAc, 40% calcium chloride and 45% water. The coagulation solution was maintained at about 110° C.

The fiber bundle exiting the coagulation solution was wound on a first roll (6 of FIG. 4) having a speed of 329.2 m/h (18 ft/m). A conditioning solution containing by weight 41.1% DMAc, 9.5% calcium chloride and 49.4% water was sprayed on the fiber bundle wetting each individual filament as the fiber bundle was wound from the first roll to a secondary roll (8 of FIG. 4) at a speed of 347.5 m/hr (19 ft/m). The conditioning solution was at 36° C.

The filaments exiting the secondary roll were run through a wet draw section; the drawing solution contained by weight 20% DMAc and 80% water. The temperature of the drawing solution was 36° C.

The filaments were wound on a second roll (10 of FIG. 4) at a speed of 1496 m/hr (81.8 ft/m), which provided a draw ratio of 4.54. After this wet draw the filaments were fed into a washing section where the fiber was washed with water at 70° C. The washing section consisted of 3 jet extractor modules. The washed fiber was wound on a third roll (12 of FIG. 4) at the same speed as the second roll (10). There was no additional drawing or stretching applied to the fiber for the remainder of the process.

Following the water wash, the fiber was dried at 125° C. The fibers had good textile properties even without being subjected to a hot stretching or a crystallization step. The physical properties of this fiber were: denier, 2.53 decitex pre filament (2.3 dpf), tenacity of 4.22 dN/tex (4.78 gpd), elongation of 30.6%, modulus of 49.8 dN/tex (56.4 gpd) and a TF of 26.46.

To show the necessity of the conditioning step, fibers were taken directly from the coagulation bath, that is without being contacted with the conditioning solution. These fibers could not be drawn and the majority of the fibers were broken. In fibers that were not broken, the physical properties were so poor that these fibers were of no practical value.

To show the physical properties that develop on crystallization, fibers produced by the present process were crystallized after washing by feeding the fiber through a hot robe and over two hot shoes at temperatures of 400°, 340° and 340° C., respectively. There was no stretching of the filaments during the crystallization step. The fiber was wound up on a final roll at a speed of 1496 m/h (81.8 ft/m), immersed in a finishing bath and wound on a bobbin. The resulting crystallized filaments were 2.2 decitex per filament (2 dpf) with a tenacity of 5.2 dN/tex (5.87 gpd), an elongation at break of 25.7% and a modulus of 90.2 dN/tex (102.2 gpd).

Example 2

Fiber was wet spun as described in Example 1 except that the conditioning solution was applied to the filaments in a jet extraction module; the first roll was by-passed.

The resulting fiber was drawn, dried and crystallized as described in Example 1. The resulting physical properties of this fiber was a tenacity of 5.2 dN/tex (5.9 gpd), an elongation at break of 26.4% and a modulus of 90.1 dN/tex (102 gpd).

Example 3

Fiber was wet spun as described in Example 1 except that concentrations of the various solutions were those shown in Tables I, Ia and Ib. The properties of the resulting fibers were measured and are shown in Table II. The steps and the various rolls used in the continuous process are identified in FIG. 4 and in the Detailed Description of the Invention above. The speed of the rolls is given in meters per hour (feet per minute).

TABLE I

| | COAGULATION | | | | |
|---|---|---|---|---|---|
| SAMPLE | % DMAc | % CACL2 | % H2O | TEMP. °C. | ROLL 1 MPH(FPM) |
| A | 15.1 | 39.7 | 45.2 | 111 | 329.2(18) |
| B | 16.8 | 38.8 | 44.4 | 109 | BYPASSED |
| C | 17.7 | 39.5 | 42.8 | 108 | BYPASSED |
| D | 19.8 | 41 | 39.2 | 111 | 219.5(12) |
| E | 20.6 | 41.2 | 38.2 | 110 | 261.5(14.3) |
| F | 17.6 | 38.9 | 43.5 | 110 | BYPASSED |
| G | 20.0 | 40.0 | 40.0 | 110 | 329.2(18) |
| H | 18.5 | 40.1 | 41.3 | 110 | BYPASSED |
| I | 18.7 | 41.7 | 39.6 | 110 | 329.2(18) |
| J | 16.8 | 38.5 | 44.7 | 109 | BYPASSED |

TABLE I shows the composition in weight percent of the coagulation solution for fiber samples A–J TABLE Ia

| CONDITIONING | | | | | |
|---|---|---|---|---|---|
| SAMPLE | % DMAc | % CACL2 | % H2O | TEMP. °C. | ROLL 1A MPH(FPM) |
| A | 41.1 | 9.51 | 49.37 | 35.6 | 353(19.3) |
| B* | 46.3/49 | 11.4/7.9 | 42.3/43.1 | 36/38.4 | 439(24) |
| C | 49.3 | 8.80 | 41.9 | 36.5 | 281.7(15.4) |
| D | 44.5 | 9.9 | 45.6 | 36 | BYPASSED |
| E | 38.2 | 10.8 | 51.1 | 35.5 | 283.5(15.5) |
| F* | 46.1/48.2 | 10.7/6.59 | 43.2/45.2 | 38/37 | 742.6(40.6) |
| G | 40.2 | 10.4 | 49.4 | 35.6 | 347.5(19) |
| H | 44.6 | 11.9 | 43.5 | 35.9 | 329.2(18) |
| I | 41.8 | 11.8 | 46.4 | 36 | 354.8(19.4) |
| J* | 52.4/53.7 | 7/8.1 | 40.6/38.2 | 36.00 | 329.2(18) |

TABLE Ia shows the composition by weight percent of the conditioning solution used for samples A–J. Samples marked with * indicate that two jet extraction units in series were used to apply the conditioning solution. The concentrations of each solution used in the jet extractors is shown in the table separated by a slash (/).

TABLE Ib

| DRAWING | | | | | |
|---|---|---|---|---|---|
| SAMPLE | % DMAc | % H2O | TEMP. °C. | ROLL 2 MPH(FPM) | TOTAL DRAW |
| A | 20 | 80 | 36 | 1496(81.8) | 4.54 |
| B | 20 | 80 | 36 | 1975(108.0) | 4.50 |
| C | 20 | 80 | 36 | 1496(81.8) | 5.31 |
| D | 20 | 80 | RT | 997(54.5) | 4.54 |
| E | 20 | 80 | 35 | 1163(63.6) | 4.45 |
| F | 20 | 80 | 36 | 1496(81.8) | 2.01 |
| G | 30 | 70 | 44 | BYPASSED | |
| H | 20 | 80 | 30.3 | 1496(81.8) | 4.56 |
| I | 20 | 80 | 45 | 1496(81.8) | 4.52 |
| J | 20 | 80 | 37 | 1496(81.8) | 4.54 |

TABLE Ib shows the composition in weight percent of the drawing solution used in preparing fiber samples A–J. The draw ratio is the factor by which fiber length was increased in a single wet draw step. In this Example, all rolls following roll 2 turned at the same speed and thus provided no additional draw or stretch. There will be some trace amount of $CaCl_2$ in the drawing solution carried in by the fiber, but $CaCl_2$ was not a component added initially to the drawing solution. In the Temperature data listed above, RT indicates room temperature which was approximately 20° C.

TABLE II

| PHYSICAL PROPERTIES | | | | | |
|---|---|---|---|---|---|
| SAMPLE | DECITEX PER FILAMENT (dpf) | TENACITY dN/TEX (gpd) | % ELONG | MODULUS dN/TEX (gpd) | TF |
| A | 2.2(2.0) | 5.18(5.87) | 25.7 | 90.3(102.2) | 29.78 |
| B | 2.2(2.0) | 5.22(5.91) | 26.4 | 98.0(111.0) | 30.38 |
| C | 2.2(2.0) | 6.59(7.46) | 16.3 | 140.3(158.7) | 30.11 |
| D | 30.4(27.6) | 3.20(3.62) | 19 | 86.2(97.6) | 15.78 |
| E | 0.6(0.5) | 4.97(5.63) | 30.4 | 84.4(95.6) | 31.07 |
| F | 2.2(2.0) | 2.08(2.36) | 81.7 | 37.3(42.2) | 21.33 |
| G | 2.1(1.9) | 3.84(4.35) | 13.9 | 98.7(111.8) | 16.21 |
| H | 2.3(2.1) | 4.12(4.67) | 16.4 | 101.3(114.7) | 18.88 |
| I | 2.1(1.90) | 4.55(5.15) | 20.3 | 107.6(121.9) | 23.18 |
| J | 2.2(2.0) | 4.29(4.86) | 26.4 | 84.3(95.5) | 24.95 |

TABLE II shows the fiber physical properties developed in samples A–J. In the Table, ELONG means elongation reported as a percent; TF is the toughness factor.

Example 4

The following example illustrates the effect of the salt content of the spinning solution (spin dope) on the physical properties of the fibers produce by the present process. The fiber was wet spun as described in Example 1 except the salt content of the polymer spinning solution was varied as shown in Table III.

TABLE III

| % Ca Cl2 in spin dope | Wet Draw Ratio | dtex/f | T | E | Modulus | TF |
|---|---|---|---|---|---|---|
| 3 | 4.5X | 2.2(2.0) | 2.7(3.1) | 8.8 | 101(114) | 9.3 |
| 4.5 | 4.5X | 2.1(1.9) | 3.7(4.2) | 12.5 | 116(131) | 14.7 |
| 6 | 4.5X | 2.2(2.0) | 4.4(5.0) | 17.5 | 114(129) | 21.4 |
| 9 | 4.5X | 2.2(2.0) | 4.4(5.0) | 28.3 | 91(103) | 26.4 |

TABLE III shows the effect of the salt content of the spinning solution on the physical properties that are developed in the fiber. In the Table, T means Tenacity, E stands for elongation and is reported as percent; M stands for modulus, TF is toughness factor; for properties having units SI units are given (for example, dN/TEX) followed by the corresponding English units value shown in parenthesis, (gpd).

Example 5

The following example illustrates that except for developing fiber physical properties that are required for high performance industrial uses, the present process produces desirable fiber properties without requiring a hot stretching step. The fiber was spun, conditioned, wet drawn, washed and crystallized as described in Example 1. There was no hot stretch, neither was there any drawing of the filaments after they past roll 2 as illustrated in FIG. 4.

Table IV shows physical properties developed when the fiber made according to the present invention was subjected to a single wet draw step and then dried at 125° C. then crystallized.

TABLE IV

| SAMPLE | Draw | dN/tex | T | E | Modulus | TF |
|---|---|---|---|---|---|---|
| 1 | 2.01X | 1.98 | 2.1(2.4) | 81.7 | 37(42) | 21.3 |
| 2 | 2.49X | 2.02 | 2.5(2.8) | 64.6 | 43(49) | 22.2 |
| 3 | 3.00X | 1.96 | 2.8(3.2) | 54.0 | 54(61) | 23.8 |
| 4 | 3.50X | 1.98 | 3.6(4.1) | 43.9 | 64(72) | 27.2 |
| 5 | 3.99X | 1.98 | 4.5(5.1) | 37.1 | 81(92) | 31.2 |
| 6 | 4.54X | 2.08 | 5.2(5.9) | 30.6 | 92(104) | 32.5 |
| 7 | 4.99X | 2.09 | 5.9(6.7) | 22.3 | 115(130) | 31.8 |
| 8 | 5.21X | 2.08 | 6.2(7.0) | 19.1 | 122(138) | 30.7 |

TABLE IV shows samples 1–8 produced from the process of the present invention. The draw is a single step wet draw. The fiber was dried and crystallized, but was not stretched during the crystallization step. In the Table, T means Tenacity, E stands for elongation and is reported as percent; M stands for modulus, TF is toughness factor; for properties having units SI units are given, (for example, dN/tex) followed by the corresponding English units value shown in parenthesis (gpd).

Table V shows fibers of the present invention which have been subjected to a hot stretch. The fibers were first wet drawn at draw ratios from 2 to about 5 followed by a hot stretch to additionally draw and to crystallize the fiber. The draw ratio in the hot stretch ranged from 1.10 to 2.27. The total draw ratio, which is the product of the wet and dry draw ratios, was about 5. Sample number 14 was made according to the present invention. For sample 14, the full draw was accomplished as the wet draw; there was no additional hot stretching although the fiber was crystallized by heat treatment.

TABLE V

| SAMPLE | Draw Ratio Wet/Hot/Total | dN/tex | T, | E, % | Modulus | TF |
|---|---|---|---|---|---|---|
| 9 | 2.00/2.27/4.54 | 2.08 | 3.1(3.5) | 20.2 | 79(90) | 15.9 |
| 10 | 2.50/1.82/4.54 | 2.03 | 3.4(3.8) | 17.3 | 85(97) | 15.9 |
| 11 | 3.00/1.51/4.54 | 2.01 | 4.0(4.5) | 21.3 | 87(99) | 21.0 |
| 12 | 3.50/1.30/4.54 | 2.03 | 4.4(5.0) | 23.3 | 95(108) | 24.2 |
| 13 | 4.00/1.14/4.54 | 2.04 | 5.0(5.7) | 24.4 | 101(114) | 28.3 |
| 14 | 4.54/1.00/4.54 | 2.04 | 5.2(5.9) | 26.9 | 100(113) | 30.6 |
| 15 | 4.54/1.10/4.99 | 2.03 | 5.7(6.5) | 22.2 | 110(125) | 30.6 |

Table V shows fibers of the present invention which have been processed an addition step to crystallize the polymer. In the Table, T means Tenacity, E stands for elongation and is reported as percent; M stands for modulus, TF is toughness factor; for properties having units SI units are given (for example, dN/TEX) followed by the corresponding English units value shown in parenthesis (gpd).

Example 6

This Example is intended to show the differences in the drawability of the fibers of the present invention and the development of mechanical properties of the fiber of the present invention over that of the prior art.

MPD-I polymer solution consisting of by weight 19.3% polymer solids, 9% CaCl2, about 1% water; the remainder of which was DMAc, was extruded through a spinneret into a coagulation bath. The coagulation bath contained by weight 20.4% DMAc, 40.8% Ca $Cl_2$ and 38.9% water and was operated at 110° C. The fiber bundle formed was treated with a conditioning solution of the following composition 40.8% DMAc, 10.7% $CaCl_2$ and 48.4% water such that each filament was contacted by this solution. The conditioning solution was maintained at 38° C. The conditioned filaments were drawable without difficulty and exhibited low draw tension. The wet draw was accomplished in a solution of 20% DMAc in water at a ratio of 4.31. After drawing, the fiber was washed in water and dried at 120° C. The fiber was then crystallized at 405° C., but without any stretching. The filaments developed the following physical properties: tenacity, 4.7 dN/tex (5.35 gpd); elongation, 29.1%, and modulus, 80 dN/tex (90.6 gpd) with a toughness factor, (TF) of 28.9.

For comparison the same spinning solution was wet spun into a first and second coagulation solution as is taught in Japanese Patent Publication Kokou Sho 56-5844 (please see FIG. 1 for a comparison of the solution concentrations of the present invention with those taught in Kokou Sho 56-5844). The composition of the first coagulation solution was by weight 20.6% DMAc, 41.7% Ca $Cl_2$ and 39.7% water and was operated at 110° C. Following the first coagulation solution the fiber bundle was contacted with a solution (the second coagulation solution at 36° C.). This second coagulation solution was applied in the place of, but using the same techniques of application as the conditioning solution of the present process. The composition of this second coagulation solution was formulated as taught in Sho 56-5844 to continue to cause solvent to leave the filament structure. This solution was formulated at the high end of the solvent concentrations taught in the publication since lower concentrations of solvent would have an even higher concentration gradient causing greater concentrations of solvent to leave the fiber. The composition of this second coagulation solution was 20.4% DMAc, 5.5% Ca $Cl_2$ and 74.1% water. This solution was applied to the fiber bundle using the technique of application of the conditioning solution of the present invention. The filaments, formed from the combination and concentrations of solutions as taught in the reference, would not draw in the wet draw step of the present invention. The fiber tension was high and the filaments were broken during the attempt to wet draw them at a ratios equal to and below that of 4.31. Thus, the fiber could not be processed further.

This comparison shows that it is impossible to use the second coagulation bath as taught in the prior art to produce a fiber that is wet drawable. In this comparison the fiber of the present invention was fully drawn in a single step that immediately followed the conditioning step. There was no additional stretching in any subsequent process steps, yet the mechanical properties produced by the present process are comparable to those achieved in the spinning and processing of fiber by dry-spinning or low salt and salt-free wet spinning.

Example 7

This Example is intended to show the differences in dye acceptance and color development of the fibers of the present invention which are wet drawn, but that have not been crystallized with fibers which have been wet spun, dried and hot stretched.

Fiber prepared in Example 1, except that the filaments were not crystallized, was dyed to compare its dye acceptance to that of a hot stretched wet spun control fiber sample. Each fiber sample was cut into 2 inch (5.08 cm) lengths and carried. A dye solution was prepared by adding to 200 ml of water 8 grams of the aryl ether carder Cindye C-45 (manufactured by Stockhausen, Inc.), 4 grams of sodium nitrate and enough Basacryl red GL (basic red #29) dye to make the solution 3% dye on the weight of the fiber.

Before exposing the fiber to the dye solution, the solution was adjusted to a pH of about 3.0 using a dilute solution of acetic acid. The dye solutions was made up in a dye can so that the fiber samples could be added to the dye solution and heated for the dye reaction to take place.

2.5 gram samples of the fiber of the present invention and the control fiber were each placed in a separate nylon knit bag. Each bag was placed in the solution in the dye can. The dye can was sealed, placed in an dyeing apparatus and heated to 70° C. at a rate of 1.5° C. per minute. The dye can was held at 70° C. for 15 minutes. The temperature of the dye can was then raised at the rate of 1.5° C. to a temperature of 130° C. and held at that temperature for 60 minutes. The dye can was then cooled to about 50° C., and the dye solution was replaced by a solution of 0.5% by weight Merpol® LFH surfactant (produced by DuPont) and 1% acetic acid in water. The dye can was again sealed and heated to a temperature of 85° C. and held for 30 minutes. The dye can was then removed form the apparatus and opened a second time, and the fiber was removed from the can, rinsed with cold water and air dried.

The color that developed in the fiber samples was read using a colorimeter with a D-65 light source and reported as L* a* b* values. The fiber of the present invention, which had only been dried, had an L* of 39.9, an a* of 46.8 and a b* of 3.76. The control fiber which was fully crystallized by the hot stretch had an L* of 67.8, an a* of 28.1 and a b* of −2.6. The color difference in these two samples when compared to one another and reported as ΔE of 34.23 showing that the fiber of the present invention was dyed to a much deeper shade than the hot stretched fiber of the prior art.

A comparison of the physical properties showed that the wet dram, but uncrystallized fiber had the following physical properties: denier, 2.53 decitex pre filament (2.3 dpf), tenacity of 4.22 dN/tex (4.78 gpd), elongation of 30.6%, modulus of 49.8 dN/tex (56.4 gpd) and a TF of 26.46; while the hot stretched fiber of the prior art had a denier of 2.23 decitex pre filament (2.03 dpf), a tenacity of 4.43 dN/tex (5.02 gpd), an elongation of 23.3%, a modulus of 95.2 dN/tex (107.8 gpd) and a TF of 24.2.

What is claimed is:

1. A process for wet spinning a meta-aramid polymer from a solvent spinning solution containing concentrations of polymer, solvent, water and at least 3% by weight salt comprising the steps of:

(a) coagulating the polymer into a fiber in an aqueous coagulation solution containing a mixture of salt and solvent such that the concentration of the solvent is from about 15 to 25% by weight of the coagulation solution and the concentration of the salt is from about 30% to 45% by weight of the coagulation solution and wherein the coagulation solution is maintained at a temperature from about 90° to 125° C.;

(b) removing the fiber from the coagulation solution and contacting it with an aqueous conditioning solution containing a mixture of solvent and salt such that the concentrations of solvent, salt and water are defined by the area shown in FIG. 1 as bounded by coordinates W, X, Y and Z and wherein the conditioning solution is maintained at a temperature of from about 20° to 60° C.;

(c) drawing the fiber in an aqueous drawing solution having a concentration of solvent of from 10 to 50% by weight of the drawing solution and a concentration of salt of from 1 to 15% by weight of the drawing solution;

(d) washing the fiber with water; and (e) drying the fiber.

2. The process of claim 1 wherein following the drying step the fiber is heated at a temperature and for a time sufficient to essentially crystallize the fiber.

3. The process of claim 1 wherein the salt is a chloride or a bromide having a cation selected from the group consisting of calcium, lithium, magnesium and aluminum.

4. The process of claim 1 wherein the solvent is selected from the group consisting of dimethylformamide, dimethylacetamide, N-methyl-2-pyrrolidonne and dimethyl sulfoxide.

5. The process of claim 1 wherein the meta-aramid polymer contains at least 25 mole % (with respect to the polymer) of poly(meta-phenylene isophthalamide).

6. The process of claim 1 wherein the draw ratio is from about 2.5 to 6.

7. The process of claim 1 wherein the draw ratio is from about 4 to 6.

* * * * *